US006178698B1

(12) United States Patent
Benson et al.

(10) Patent No.: US 6,178,698 B1
(45) Date of Patent: Jan. 30, 2001

(54) BALANCED DOOR CLOSING APPARATUS

(75) Inventors: Jeffrey P. Benson, Jamestown; Bradley J. Benson, Bemus Point, both of NY (US)

(73) Assignee: Dawson Metal Company, Inc., Jamestown, NY (US)

( * ) Notice: Under 35 U.S.C. 154(b), the term of this patent shall be extended for 0 days.

(21) Appl. No.: 09/337,442

(22) Filed: Jun. 21, 1999

(51) Int. Cl.[7] ..... E05D 7/06
(52) U.S. Cl. ..... 49/242
(58) Field of Search ..... 49/236, 240, 241, 49/242, 243, 244

(56) References Cited

U.S. PATENT DOCUMENTS

| | | | | |
|---|---|---|---|---|
| 1,015,676 | * | 1/1912 | Graham | 49/242 |
| 1,235,381 | * | 7/1917 | Respini | 49/242 |
| 3,510,986 | * | 5/1970 | Berkowitz | 49/386 |
| 3,605,339 | | 9/1971 | Catlett et al. . | |
| 4,286,411 | | 9/1981 | Wikkerink et al. . | |
| 5,309,676 | | 5/1994 | Appelmann et al. . | |
| 5,606,773 | * | 3/1997 | Shappell | 49/386 X |
| 5,829,508 | * | 11/1998 | DeBower et al. | 49/386 X |

* cited by examiner

*Primary Examiner*—Jerry Redman
(74) *Attorney, Agent, or Firm*—Phillips, Lytle, Hitchcock, Blaine & Huber LLP

(57) ABSTRACT

An improved door closing apparatus (20) is adapted for use with a door frame (21) that comprises an elongated header (22), a sill (23) and a pair of side jambs (24, 25). A door (26) is adapted to be mounted on the frame for pivotal movement about an axis (y—y). The improved comprises a base (29) adapted to be mounted on the header, a closer mechanism (30) mounted on the base and having a first shaft (31) adapted to be oriented perpendicularly with respect to the axis of elongation of the header. The closer mechanism is operatively arranged to selectively urge the first shaft to rotate relative to the closer mechanism. A second shaft (33) is mounted on the base for pivotal movement relative thereto. The second shaft is substantially aligned with the pivotal excess of the door. First and second arms (34, 35) are mounted on the first and second shafts, respectively, for movement therewith. A link (36) pivotally connects the first and second arms that respective locations eccentric to the axes of the first and second shafts. Hence, a force transmitted by the closing mechanism may be transmitted through the first shaft, the first arm, the link, the second arm and the second shaft to urge the door to pivot in one direction about its axis.

5 Claims, 1 Drawing Sheet

20
21
22
23
24
25
26
28
29
30
31
33
34
35
36
38
3
y

BALANCED DOOR CLOSING APPARATUS

TECHNICAL FIELD

The present invention relates generally to door closers, and, more particularly, to an improved door closing apparatus for a balanced door.

BACKGROUND ART

A balanced door is generally considered to be a door in which the axis of rotation is relatively close to the center of its area. Hence, the door may be operated with less effort then a conventional door, which is hinged at one side. The present invention relates generally to an improved balanced door closing apparatus. However, the inventive improvement is not limited to this one particular end use.

In generally, a door has a header, a pair of transversely-spaced jambs, and a base. These elements define the door opening. The door is operatively arranged within this opening. As indicated above, a balanced door is hinged or pivoted about an intermediate portion of its width, as opposed to being hinged at one end.

Various details of prior art balanced doors and door closing apparatuses are shown and described in U.S. Pat. Nos. 5,309,676, 3,605,339 and 4,286,411.

Accordingly, it would generally desirable to provide an improved door closer apparatus that is compact, may readily be reversed for either a left-handed door or a right-handed door, and which may be readily mounted on the header.

DISCLOSURE OF THE INVENTION

With parenthetical reference to the corresponding parts, portions or surfaces of the disclosed embodiment, merely for purposes of illustration and not by way of limitation, the present invention broadly provides an improved door closing apparatus (20) that is adapted for use with a door frame (21) that includes an elongated header (22), a base (23) and a pair of side jambs (24, 25) arranged to define a door opening, and within a door (26) is adapted to be mounted on the frame for pivotal movement about an axis (y—y). The improved apparatus broadly includes: a base (29) adapted to be mounted on the header; a closure mechanism (30) mounted on the base and having a first shaft (31) oriented perpendicularly with respect to the header axis of elongation, the closure mechanism being operatively arranged to selectively urge the first shaft to rotate relative to the closure mechanism; a second shaft (33) mounted on the base for pivotal movement relative thereto, the second shaft being substantially aligned with the pivotal axis of the door; a first arm (34) mounted on the first shaft for rotation therewith; a second arm (35) mounted on the second shaft for rotation therewith; and a link (36) pivotally connected to the first and second arms at respective locations eccentric to the axes of the first and second shafts; whereby a force transmitted by said closing mechanism may be transmitted through said first shaft, first arm, link, second arm and second shaft to urge the door to pivot in one direction about its axis. The improved may further include adjustment means (38) for adjusting the length of the link. This adjustment means may include at least one threaded connection. In the preferred embodiment, the first axis is substantially horizontal, and the second axis is substantially vertical, when the improved or closer apparatus is mounted on the door frame.

Accordingly, the general object of the invention is to provide an improved door closing apparatus.

Another object is to provide an improved door closing apparatus which is relatively compact, and which may be readily reversed to accommodate either a left-hand or right-hand door.

Still another object is to provide an improved door closing apparatus that may be readily mounted on the header of a door frame.

These and other objects and advantages will be, apparent from the foregoing and ongoing written specification, the drawings, and the appended claims.

DESCRIPTION OF THE PREFERRED EMBODIMENT(S)

Figures 1, 2, 3, 4, 5, 6:
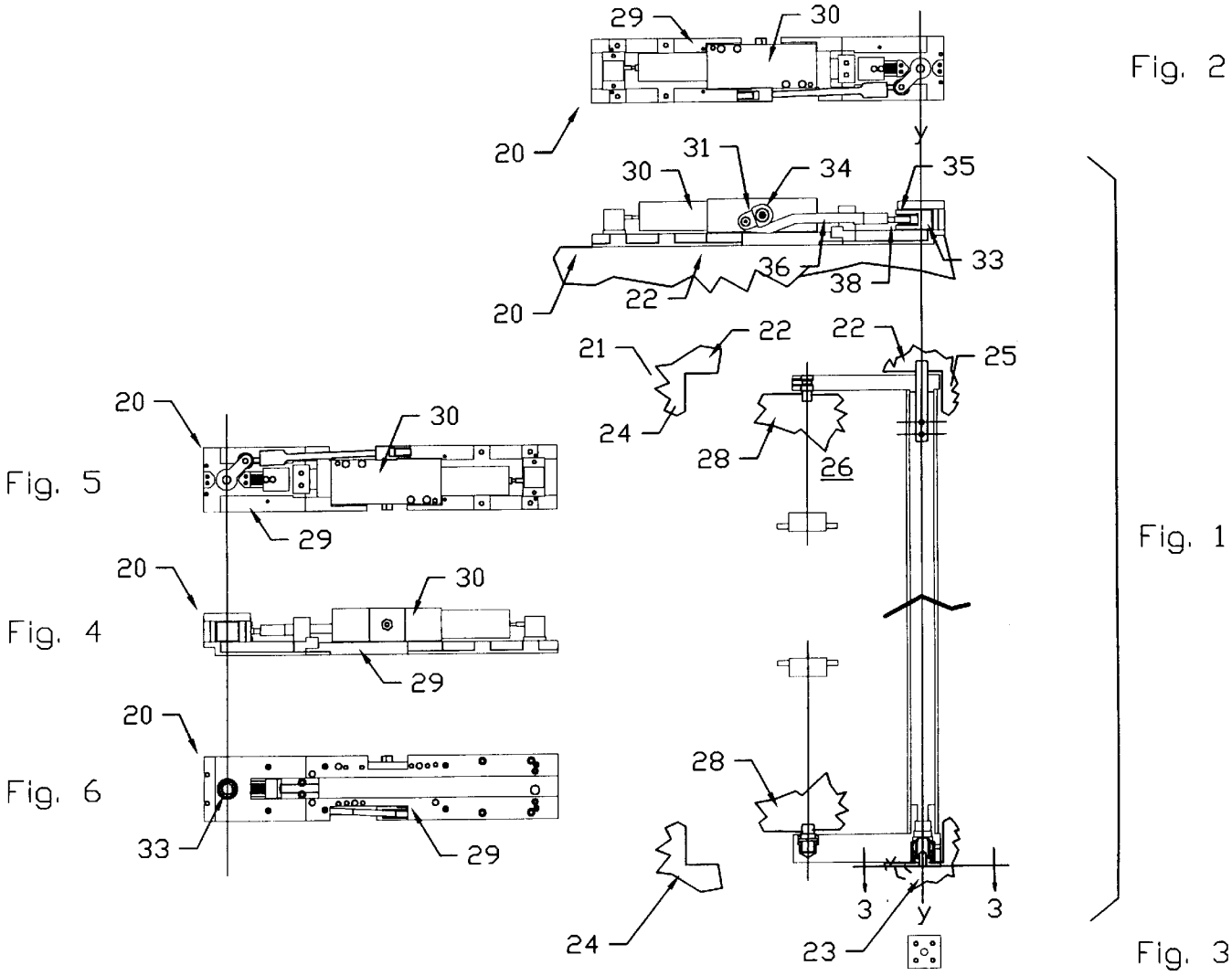
FIG. 1 is an exploded view, partly in elevation and partly in vertical section, of an improved balanced door assembly, showing the door closing apparatus as being mounted on the header.
FIG. 2 is a top plan view of the door closing apparatus shown in FIG. 1.
FIG. 3 is a top plan view of the base plate mounted in the base.
FIG. 4 is a rear elevation of the door closing apparatus shown in FIGS. 1 and 2.
FIG. 5 is a top plan view of the door closing apparatus shown in FIG. 4.
FIG. 6 is a bottom plan view of the door closing apparatus shown in FIG. 4.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up"and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring to the drawings, and, more particularly, to FIG. 1 thereof, the present invention broadly provides an improved door closing apparatus, generally indicated at 20, for use with a door frame, portions of which are fragmentarily illustrated in FIG. 1 at 21. That frame includes an elongated header 22, a sill 23, a pair of horizontally-spaced side jambs 24, 25 that are operatively ranged to define a door opening at 26. A door, portions of which are indicated at 28, is adapted to be mounted on the frame for pivotal movement about an axis y—y. In the preferred embodiment, the door is an intermediately-mounted balanced door. However, while this arrangement is presently preferred, the invention is not limited to use with such intermediately-pivoted balanced doors, but can, alternatively, be used with conventional edge-mounted doors as well.

Referring now collectively to FIGS. 1–6, the improved door closing apparatus 20 is shown as broadly including a horizontally-elongated rectangular plate-like base 29 which is adapted to be mounted on the header 22. A closer mechanism, generally indicated at 30, is operatively mounted on the base. This closer mechanism is individually "old." It basically includes a body having a spring-biased actuator therein. The closer mechanism has a first shaft 31 that is normally arranged to be oriented perpendicularly (i.e., horizontally) with respect to the header. The closer mechanism is operatively arranged to selectively urge this first shaft to rotate in one angular direction relative to the body of the closer mechanism. A second shaft, indicated at 33, is mounted on the base for pivotal movement relative thereto. This second shaft is substantially aligned with the pivotal axis y—y of the door. Thus, whereas the first shaft is normally horizontal, the second shaft is normally vertical. A first arm 34 is operatively mounted on the first shaft for rotation therewith. A second arm 35 is operatively mounted on the second shaft for rotation therewith. A link 36 is pivotally connected to the first and second arms at locations eccentric to the respective axes of the first and second shafts. Hence, a force transmitted by the closing mechanism may be transmitted through the first shaft, first arm, link, second arm and second shaft to urge the door to pivot in one direction relative to its axis.

In the preferred embodiment, the improved apparatus further includes adjustment means, generally indicated at 38, for adjusting the length of this link. This adjustment means may include at least one threaded connection, such as a turnbuckle.

One unique feature of this particular closer mechanism lies in the fact that the first shaft extends laterally outwardly from either side, as shown in FIG. 5. Hence, the first arm may be operatively mounted on either end of the first shaft, depending on whether the door is intended for left-hand or right-hand operation.

Modifications

The present invention contemplates that many changes and modifications may be made. For example, while the basis shown as being a horizontally-elongated rectangular plate-like member, the base could have other shapes or forms as well. Similarly, the closer mechanism may be a commercially-available off-the-shelf item, or may be of some special design. Whether the closer mechanism has the exposed marginal ends of the first shaft extending outwardly from either side, it is entirely optional. The first and second arms are described functionally. Hence, they may have various shapes and configurations. Similarly, the link is not limited to the precise form shown, but may have other shapes and configurations as well.

Therefore, while the presently preferred form of the improved door closing apparatus as been shown and described, and several modifications thereof discussed, persons skilled in this art will readily appreciate that various additional changes and modifications may be made without departing from the spirit of the invention, as defined and differentiated by the following claims.

What is claimed is:

1. A door closing apparatus adapted for use with a door frame comprising an elongated header and a pair of side jambs arranged to define a door opening, and wherein a door is adapted to be mounted an said frame for pivotal movement about an axis, wherein the improvement comprises:

a base adapted to be mounted on said header;

a closer mechanism mounted on said base and having a first shaft adapted to be oriented perpendicularly with respect to the header axis of elongation, said closer mechanism being operatively arranged to selectively urge said first shaft to rotate relative to said closer mechanism;

a second shaft mounted on said base for pivotal movement relative thereto, said second shaft being substantially aligned with an axis with respect to which said door is constrained to move;

a first arm mounted on said first shaft for rotation therewith;

a second arm mounted on said second shaft for rotation therewith; and a link pivotally connected to said first and second arms at respective locations eccentric to the axes of said first and second shafts;

whereby a force transmitted by said closing mechanism may be transmitted through said first shaft said first arm, said link, said second arm and said second shaft to urge said door to pivot in one direction about its axis.

2. A door closing apparatus as set forth in claim 1 and further comprising adjustment means for adjusting the length of said link.

3. A door closing apparatus as set forth in claim 2 wherein said adjustment means includes at least one threaded connection.

4. A door closing mechanism as set forth in claim 1 wherein said first axis is substantially horizontal, and said second axis is substantially vertical.

5. A door closing mechanism as set forth in claim 1 wherein said door is a balanced door.

* * * * *